US007439666B1

(12) United States Patent
Liu et al.

(10) Patent No.: US 7,439,666 B1
(45) Date of Patent: Oct. 21, 2008

(54) FIELD EMISSION DISPLAY DEVICE WITH FLEXIBLE GATE ELECTRODE AND METHOD FOR MANUFACTURING THE SAME

(75) Inventors: Tien-Sung Liu, Guanyin Township, Taoyuan County (TW); Chih-Che Kuo, Guanyin Township, Taoyuan County (TW)

(73) Assignee: Teco Nanotech Co., Ltd., Taoyuan (TW)

( * ) Notice: Subject to any disclaimer, the term of this patent is extended or adjusted under 35 U.S.C. 154(b) by 0 days.

(21) Appl. No.: 11/760,893

(22) Filed: Jun. 11, 2007

(51) Int. Cl.
*H01J 1/62* (2006.01)

(52) U.S. Cl. ..... 313/495; 313/493

(58) Field of Classification Search ..... 313/495–497, 313/309, 336, 351
See application file for complete search history.

(56) References Cited

U.S. PATENT DOCUMENTS 5,710,483 A * 1/1998 Peng ..... 313/497
5,818,165 A * 10/1998 Malhi ..... 313/495
7,045,807 B2 * 5/2006 Choi ..... 257/10

* cited by examiner

*Primary Examiner*—Joseph L Williams

(57) ABSTRACT

A field emission display device with flexible gate electrode and method for manufacturing the same. The field emission display device includes a cathode plate, a gate electrode and an anode plate. The cathode plate includes a cathode substrate and supports on both sides of the cathode. A recess is defined on outer bottom face of the support. The gate electrode includes a flexible mesh and a plurality of fixing tabs on both sides of the flexible mesh. The fixing tab is locked into the recess. The flexible mesh is arranged on the supports in stretching manner. The anode plate includes an anode substrate. A sealing spacer is arranged on the peripheral of the anode substrate and connected to the peripheral of the cathode substrate. The sealing spacer presses the fixing tabs evenly against the cathode substrate to induce a tension force to the flexible mesh.

10 Claims, 3 Drawing Sheets

FIELD EMISSION DISPLAY DEVICE WITH FLEXIBLE GATE ELECTRODE AND METHOD FOR MANUFACTURING THE SAME

BACKGROUND OF THE INVENTION

1. Field of the Invention

The present invention relates to a field emission display device, especially to a field emission display device with flexible mesh and a method for manufacturing the same.

2. Description of Prior Art

Display industry has rapid progress as the development of new material and technology. Compact and light-weight display devices, such as flat panel display, have successfully eroded the market share of bulky CRT display. Moreover, the flat panel display has also penetrated to the application of mobile phone screen and outdoor sign board as the resolution and brightness of the flat panel display are improved.

Field emission display (FED) device is an attractive flat panel display device because FED device has self luminance and does not need additional backlight. Therefore, FED has higher brightness and broader view angle, as well as lower power consumption and faster response speed. The performance of FED device can be enhanced when it is incorporated with nano material in the structure thereof.

A prior art triode FED device generally comprises an anode plate, a cathode plate and a gate electrode between the anode and the cathode. The gate electrode provides an electrical potential to attract free electrons from the cathode plate. The anode plate provides an electrical potential to accelerate the attracted free electrons to bombard the anode plate for luminance.

The above-mentioned gate electrode is generally implemented in metal mesh made of conductive wires. The metal mesh comprises a plurality of apertures through which free electron can pass. The wire portion of the metal mesh generates an electrical field to attract the free electrons. The metal mesh made of conductive wires or conductive material is extensively applied for triode FED device because the manufacture process for the metal mesh is simple.

However, the electrons not passing through the apertures tend to accumulate on the conductive wires of the metal mesh because the metal mesh is made of conductive wires. The metal mesh is deformed by thermal expansion after the metal mesh is heated. The propagation path of the free electrons is influenced because the location of the aperture is in turn changed. Moreover, the metal mesh also has vibration problem due to the voltage change of the driving circuit. Therefore, the electric field generated by the metal mesh is not uniform. The alignment between the free electrons and the apertures is deteriorated. It is desirable to provide a mesh structure to overcome above drawbacks.

SUMMARY OF THE INVENTION

The present invention is to provide a field emission display device with flexible mesh to overcome thermal expansion and vibration problem, and a method for manufacturing the same Accordingly, the present invention provides a field emission display device with flexible mesh and a method for manufacturing the same. The field emission display device according to the present invention comprises a cathode plate, a gate electrode and an anode plate. The cathode plate includes a cathode substrate and supports on both sides of the cathode. A recess is defined on outer bottom face of the support. The gate electrode includes a flexible mesh and a plurality of fixing tabs on both sides of the flexible mesh. The fixing tab is locked into the recess. The flexible mesh is arranged on the supports in stretching manner. The anode plate includes an anode substrate. A sealing spacer is arranged on the peripheral of the anode substrate and connected to the peripheral of the cathode substrate. The sealing spacer presses the fixing tabs evenly against the cathode substrate to induce a tension force to the flexible mesh.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
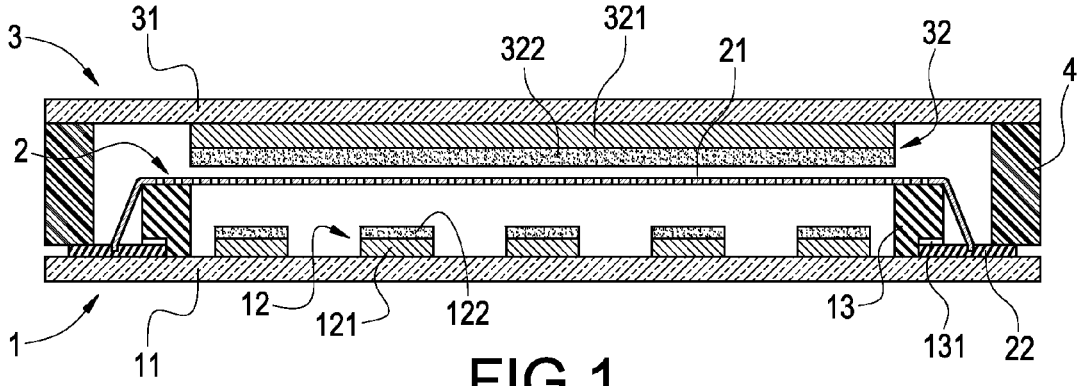
FIG. 1 shows a sectional view of the present invention.
Figure 5:
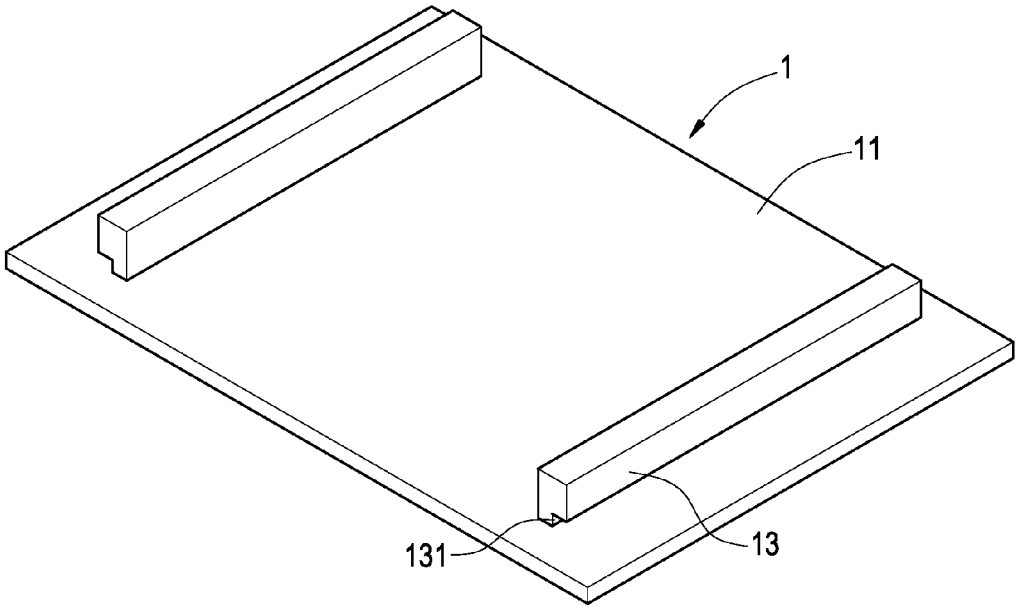
FIG. 5 shows the support according to a preferred embodiment of the present invention.
Figure 6:
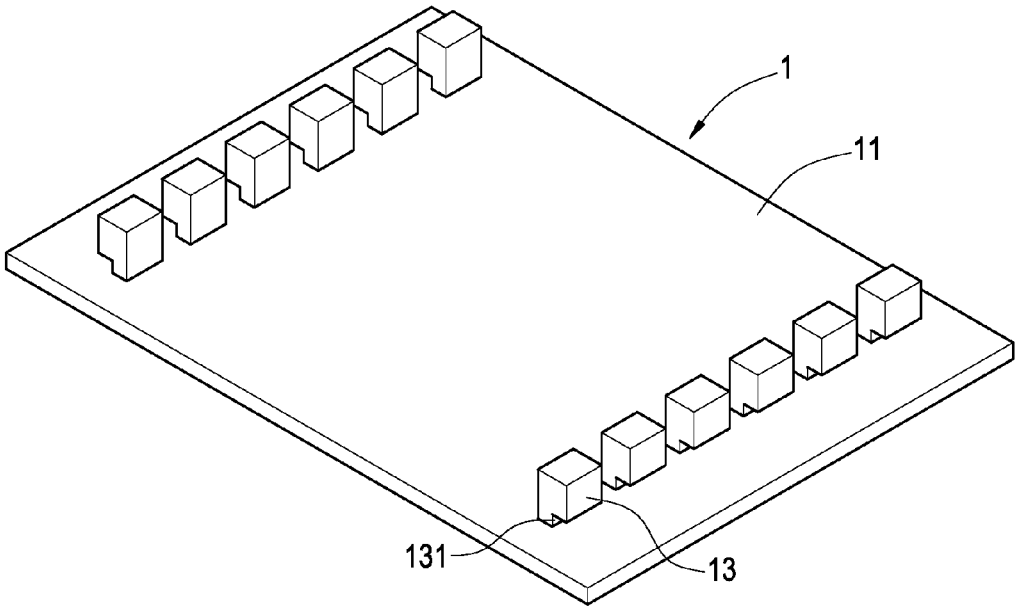
FIG. 6 shows the support according to another preferred embodiment of the present invention.

FIG. 1 shows a sectional view of the present invention. The FED device of the present invention comprises a cathode plate 1, a gate electrode 2 and an anode plate 3. The cathode plate 1 comprises a cathode substrate 11 and a plurality of cathode units 12 on the cathode substrate 11. The cathode unit 12 comprises a cathode conductive layer 121 and an emitter layer 122. The emitter layer 122 is used for releasing electron by the attracting action of an electrical field. Supports 13 are provided at both sides of the cathode units 12. According to the preferred embodiment of the present invention, the support 13 is an elongated strip. As shown in FIG. 5, an indent recess 131 is defined on the outer face of the support 13. Moreover, the support 13 can also be implemented as a pillar, as shown in FIG. 6.

Figure 3:
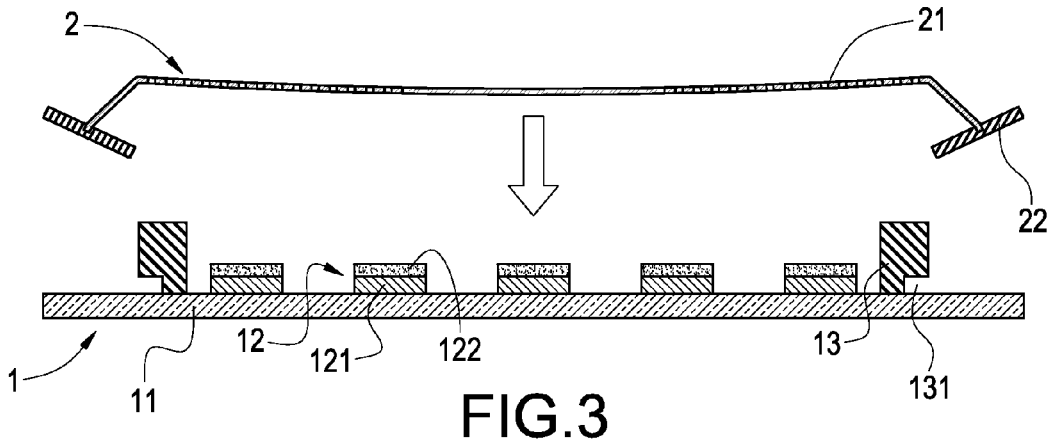
FIG. 3 shows a sectional view showing the assembling of the cathode substrate and the flexible mesh.

With reference again to FIG. 1, the gate electrode 2 comprises a flexible mesh 21 and a plurality of fixing tabs 22. As shown in FIG. 3, the flexible mesh 21 is made of invar (alloy of Fe, Ni and C). The thermal expansion coefficient of the flexible mesh 21 is $8\times10^{-7}$~$9\times10^{-7}$ 1/° C., and is preferably close to the thermal expansion coefficient of glass, whereby the outward expansion and the deformation of the flexible mesh 21 due to heat can be alleviated. The thickness of the flexible mesh 21 is equal to or below 200 μm. The fixing tabs 22 are arranged at both ends of the flexible mesh 21. Both ends of the flexible mesh 21 are connected to the surface of the fixing tabs 22, as shown in FIG. 3. The fixing tabs 22 are locked to the indent recess 131 of the support 13 such that the flexible mesh 21 corresponds to the position of the cathode units 12 of the cathode plate 1. The flexible mesh 21 is used to attract or confine the electron beam when it is supported by the support 13 with a preferred height. Both surfaces of the fixing tab 22 are coated with conductive material such as conductive paste for providing conduction path of the flexible mesh 21.

With reference again to FIG. 1, the anode plate 3 comprises an anode substrate 31 and an anode unit 32 on the anode substrate 31, where the anode unit 32 corresponds to the cathode units 12 on the cathode plate 1. The anode unit 32 comprises an anode electrode layer 321; and the anode electrode layer 321 comprises a phosphor layer 322. A sealing spacer 4 is provided at the peripheral of the anode substrate 31. The sealing spacer 4 is connected to the cathode substrate 11 to provide support between the cathode plate 1 and the anode plate 3; and facilitate to establish a vacuum state between the cathode plate 1 and the anode plate 3. Therefore, the FED device can provide sufficient space for the free electron to accelerate. The sealing space 4 is pressed against the fixing tabs 22 when the sealing spacer 4 is assembled with the cathode substrate 11. Therefore, the fixing tabs 22 on the cathode substrate 11 exert an internal tension force to the flexible mesh 21. The vibration due to thermal expansion and the driving voltage can be alleviated by the internal tension force for the flexible mesh 21.

Figure 2:
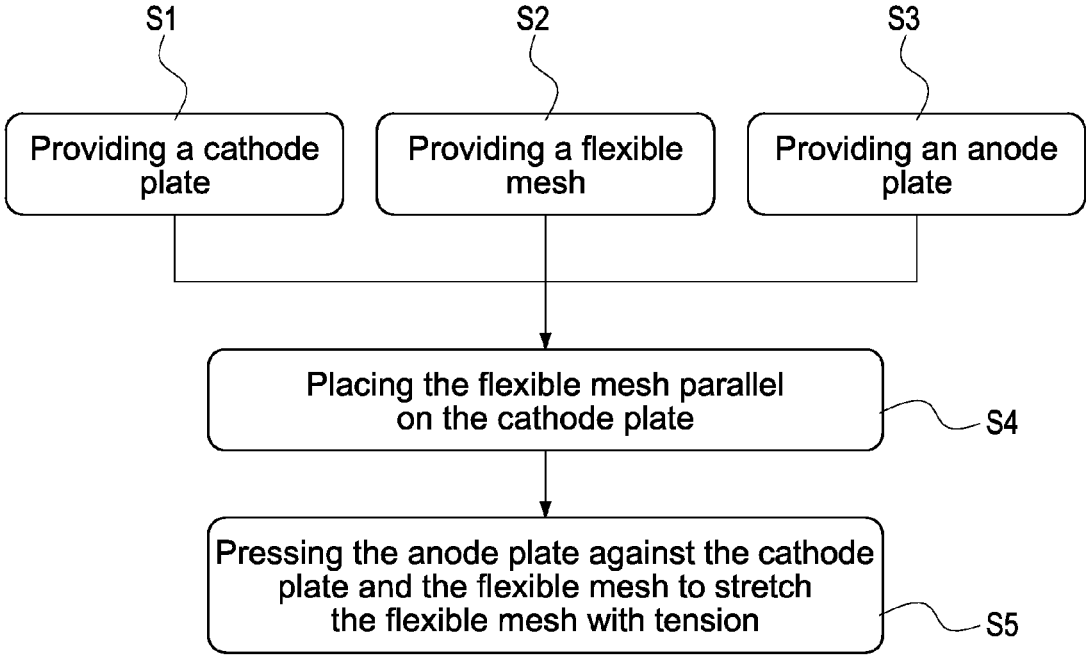
FIG. 2 shows the flowchart for manufacturing the FED device according to the present invention.
Figure 4:
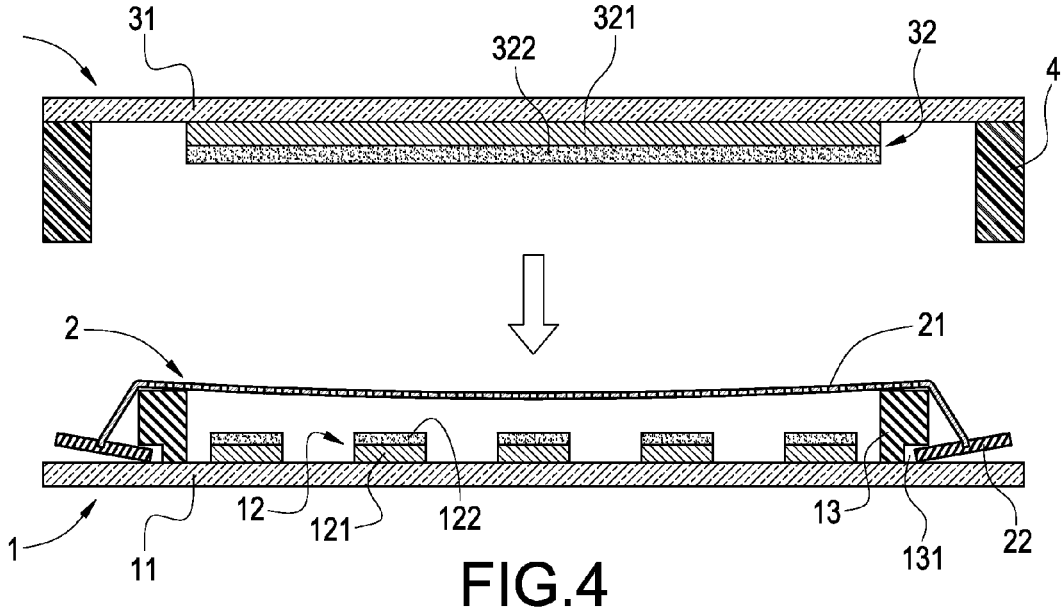
FIG. 4 shows a sectional view showing the assembling of the cathode substrate and the flexible mesh.

FIG. 2 shows the flowchart for manufacturing the FED device for the present invention. With also reference to FIGS. 3 and 4, a cathode plate 1 is provided in step S1, where the cathode plate 1 comprises a cathode substrate 11. As show in FIG. 3, the cathode substrate 11 comprises a plurality of cathode units 12. Supports 13 are provided at both sides of the cathode units 12. An indent recess 131 is defined on the outer bottom face of the support 13. A flexible mesh 21 is provided in step S2. The flexible mesh 21 and a plurality of fixing tabs 22 on both sides of the flexible mesh 21 form a gate electrode, as shown in FIG. 3. An anode plate 3 is provided in step S3. As shown in FIG. 4, the anode plate 3 comprises an anode substrate 31 and a plurality of anode units 32 on the anode substrate 31. A sealing spacer 4 is assembled along the peripheral of the anode substrate 31. The flexible mesh 21 is parallel placed on the cathode plate 1 in step S4, while the fixing tabs 22 are locked into the recess 131, as shown in FIG. 4. The anode plate 3 is assembled to the cathode plate 1 and the flexible mesh 21 to stretch tightly the flexible mesh 21 in step S5. As shown in FIG. 4, the sealing spacer 4 located at peripheral of the anode substrate 31 is pressed against the peripheral of the cathode substrate 11. The sealing spacer 4 also presses on the fixing tabs 22 such that the fixing tabs 22 are pressed evenly with the cathode substrate 11. The flexible mesh 21 is stretched with tension. The finished product for the FED device is shown in FIG. 1.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A field emission display device with flexible gate electrode, comprising:

a cathode plate, comprising a cathode substrate;

a plurality of cathode units arranged on the cathode substrate;

a plurality of supports arranged on both sides of the cathode substrate, each of the supports comprising a recess on outer bottom face thereof;

a gate electrode comprising a flexible mesh and a plurality of fixing tabs on both ends of the flexible mesh, wherein the fixing tabs are locked into the recess and the flexible mesh is arranged atop the supports;

an anode plate arranged opposing to the cathode plate and comprising an anode substrate;

an anode unit arranged on the anode substrate;

a sealing spacer arranged on the peripheral of the cathode plate and the peripheral of the anode plate, the sealing spacer pressing the fixing tabs evenly against the cathode plate, whereby a tension force is exerted on the flexible mesh.

2. The field emission display device as in claim 1, wherein the flexible mesh is made of invar, which comprises alloy of Fe, Ni and C.

3. The field emission display device as in claim 1, wherein the flexible mesh has a thickness equal to or below 200 μm.

4. The field emission display device as in claim 1, wherein the flexible mesh has a thermal expansion coefficient of $8\times10^{-7}$~$9\times10^{-7}$ 1/° C.

5. The field emission display device as in claim 1, wherein the support is elongated strip.

6. The field emission display device as in claim 1, wherein the support is of pillar shape.

7. The field emission display device as in claim 1, wherein the cathode unit comprises a cathode conductive layer and an emitter layer.

8. The field emission display device as in claim 1, wherein the anode unit comprises an anode conductive layer and a phosphor layer.

9. The field emission display device as in claim 1, wherein the fixing tab is coated with a conductive material to provide a conductive path for the flexible mesh.

10. The field emission display device as in claim 9, wherein the conductive material is a conductive paste.

* * * * *